US007542577B2

(12) United States Patent
Kiuchi

(10) Patent No.: US 7,542,577 B2
(45) Date of Patent: Jun. 2, 2009

(54) INPUT SOUND PROCESSOR

(75) Inventor: Shingo Kiuchi, Iwaki (JP)

(73) Assignee: Alpine Electronics, Inc.

( * ) Notice: Subject to any disclaimer, the term of this patent is extended or adjusted under 35 U.S.C. 154(b) by 956 days.

(21) Appl. No.: 11/070,829

(22) Filed: Mar. 1, 2005

(65) Prior Publication Data

US 2005/0195992 A1 Sep. 8, 2005

(30) Foreign Application Priority Data

Mar. 8, 2004 (JP) ..... 2004-063294

(51) Int. Cl.
*H04R 3/00* (2006.01)

(52) U.S. Cl. ..... 381/96; 381/93; 381/94.1; 381/94.2; 381/94.3; 381/66; 379/406.01; 379/406.05; 379/406.06

(58) Field of Classification Search ..... 381/96, 381/93, 94.1–94.3, 94.7, 66, 71.1, 71.4, 86, 381/92, 56–57, 122, 58–59; 379/406.01, 379/406.05–406.09, 406.12–406.13; 704/226, 704/233

See application file for complete search history.

(56) References Cited

U.S. PATENT DOCUMENTS 5,241,692 A 8/1993 Harrison et al.
6,778,601 B2 * 8/2004 Ise et al. ..... 375/232
6,847,723 B1 * 1/2005 Kiuchi et al. ..... 381/94.7
7,050,591 B2 * 5/2006 Marumoto ..... 381/58
7,177,416 B1 * 2/2007 Zhang et al. ..... 379/387.01
7,254,242 B2 * 8/2007 Ise et al. ..... 381/94.3
2002/0022957 A1 2/2002 Kiuchi et al.
2004/0042626 A1 3/2004 Balan et al.
2004/0264686 A1 * 12/2004 Enzner ..... 379/406.08

FOREIGN PATENT DOCUMENTS

JP 11166835 6/1999

* cited by examiner

*Primary Examiner*—Vivian Chin
*Assistant Examiner*—Disler Paul
(74) *Attorney, Agent, or Firm*—Brinks Hofer Gilson & Lione

(57) ABSTRACT

An input sound processor compares power at each frequency component of an input sound with a reference value, and sets multiplication points indicating frequency components at which the total power of the input sound is to be determined. A product-sum operation is performed at the multiplication points on the power at each frequency component and the square amplitude of each filter coefficient indicating the transfer characteristic from a loudspeaker to a microphone to estimate the total power of the input sound at the position of the microphone.

20 Claims, 2 Drawing Sheets

INPUT SOUND PROCESSOR

BACKGROUND OF THE INVENTION

1. Field of the Invention

The present invention relates to an input sound processor for determining the sound power at a specific point, more specifically, to an input sound processor for estimation of the power of a guide voice at a microphone.

2. Description of the Related Art

A typical navigation voice corrector for use in a navigation system changes the sound pressure level of a guide voice depending upon the ambient noise level to provide an intelligible guide voice even in noisy environments (see, for example, Japanese Unexamined Patent Application Publication No. 11-166835 (pages 3 to 6, FIGS. 1 to 10)). In this navigation voice corrector, a loudness-compensation-based gain determining unit corrects for the gain of a guide voice output from a loudspeaker based on the sound pressure levels of ambient noise and the guide voice at the position of a microphone, which is assumed to be a listening point of the guide voice. The sound pressure level of the ambient noise and the guide voice input to the loudness-compensation-based gain determining unit is represented by total sound power which is determined by summing powers at all of a plurality of frequency components.

However, the guide voice and the ambient noise actually reach the microphone at the same time, and it is not possible to extract only the guide voice from the sound collected by the microphone.

One typical technique for extracting a guide voice is estimation of the guide voice at the microphone based on the transfer characteristic from the loudspeaker to the microphone and the guide voice signal input to the loudspeaker. The total power of the guide voice at the microphone is determined by separately determining power at each frequency component of the guide voice and a square amplitude of the transfer characteristic at each frequency component and performing a product-sum operation at each frequency component (see, for example, Japanese Unexamined Patent Application Publication No. 2002-23790 (pages 3 to 4, FIGS. 1 to 2)).

The latter publication discloses that the power determined at each frequency component of an input voice is multiplied by the square amplitude of each tap coefficient indicating the transfer characteristic and a sum of the products is then calculated. It is therefore necessary to perform a product-sum operation at all frequency components, resulting in a large amount of processing. A high-performance processor is therefore required, which is costly.

SUMMARY OF THE INVENTION

Accordingly, it is an object of the present invention to provide a low-cost input sound processor with a small amount of processing.

In one aspect of the present invention, an input sound processor for estimation of total power of an input sound generated from a loudspeaker that is received at a microphone includes a first frequency analysis unit that divides an input sound signal sent to the loudspeaker into a plurality of frequency components, a first power calculating unit that determines power at each of the frequency components divided by the first frequency analysis unit, a square amplitude calculating unit that determines a square amplitude of a filter coefficient at each of the frequency components, the filter coefficient being a filter characteristic corresponding to a transfer characteristic in an acoustic space from the loudspeaker to the microphone, a power comparing unit that compares the power at each of the frequency components determined by the first power calculating unit with a reference value, a multiplication point setting unit that sets multiplication points indicating frequency components at which the total power of the input sound is to be determined based on a comparison result of the power comparing unit, and a product-sum operation unit that performs a product-sum operation at the multiplication points set by the multiplication point setting unit using the power at each of the frequency components determined by the first power calculating unit and the square amplitude of the filter coefficient at each of the frequency components determined by the square amplitude calculating unit. Thus, a product-sum operation is not performed at a frequency component having substantially no power. Therefore, the amount of processing can be reduced, and an inexpensive processor can be used, leading to cost savings.

Preferably, the multiplication point setting unit sets frequency components other than a frequency component having power equal to or lower than the reference value as the multiplication points. This ensures that a frequency component having a small product of the power and the square amplitude of each filter coefficient, which thus does not affect the overall product-sum operation, can be extracted.

Preferably, the power comparing unit compares the power at each of the frequency components determined by the first power calculating unit with the reference value, and compares the square amplitude of the filter coefficient with the reference value. Preferably, the multiplication point setting unit sets frequency components other than a frequency component having at least one of power and square amplitude equal to or lower than the reference value as the multiplication points. In view of the transfer characteristic in the acoustic space from the loudspeaker to the microphone, in particular, the transfer characteristic in the space of a vehicle cabin, a sound having a specific frequency band may be absorbed, and the square amplitude of the filter characteristic at this frequency band is very low. Thus, the product of the square amplitude and the power has a small value. A product-sum operation is not performed at this frequency band, thus reducing the amount of processing of the overall product-sum operation.

In another aspect of the present invention, an input sound processor for estimation of total power of an input sound produced from a loudspeaker received at a microphone includes a first frequency analysis unit that divides an input sound signal sent to the loudspeaker into a plurality of frequency components, a first power calculating unit that determines power at each of the frequency components divided by the first frequency analysis unit, a square amplitude calculating unit that determines a square amplitude of a filter coefficient at each of the frequency components, the filter coefficient being a filter characteristic corresponding to a transfer characteristic in an acoustic space from the loudspeaker to the microphone, a consonant or vowel determining unit that determines whether the input sound comprises a consonant or a vowel, a multiplication point setting unit that sets multiplication points indicating frequency components at which the total power of the input sound is to be determined based on a determination result of the consonant or vowel determining unit, and a product-sum operation unit that performs a product-sum operation at the multiplication points set by the multiplication point setting unit using the power at each of the frequency components determined by the first power calculating unit and the square amplitude of the filter coefficient at each of the frequency components determined by the square amplitude calculating unit.

If the input sound is a voice, the voice has large variations in the values of frequency components depending upon a consonant or a vowel. Specifically, if the voice is a composed of a consonant, the frequency components specific to the consonant have values, while the other frequency components have a value of substantially zero. If the voice is composed of a vowel, the frequency components specific to the vowel have values, while the other frequency components have a value of substantially zero. By determining whether the input sound is composed of a vowel or a consonant, a frequency component having substantially no power can be identified, and a product-sum operation at this frequency component can be omitted. Therefore, the amount of processing can be reduced, and an inexpensive processor can be used, leading to cost savings.

Preferably, the consonant or vowel determining unit compares power at a vowel frequency range with power at a consonant frequency range to determine whether the input sound comprise a consonant or a vowel. It can therefore be easily determined whether the input sound is composed of a consonant or a vowel.

Preferably, the vowel frequency range is 100 Hz to 1 kHz, and the consonant frequency range is 1 kHz to 8 kHz. Since the vowel frequency range and the consonant frequency range do not overlap each other, the consonant or vowel determination can more easily be performed.

Preferably, the input sound process further includes a consonant-range power determining unit that determines the power at the consonant frequency range by summing powers at frequency components determined by the first power calculating unit, the frequency components being included in the consonant frequency range, and a vowel-range power determining unit that determines the power at the vowel frequency range by summing powers at frequency components determined by the first power calculating unit, the frequency components being included in the vowel frequency range. Thus, the power at the consonant frequency range and the power at the vowel frequency range can be easily determined.

Preferably, the input sound processor further includes an adaptive filter that determines the filter coefficient. Preferably, the input sound processor further includes a second frequency analysis unit that divides a signal sent from the microphone into a plurality of frequency components, wherein the adaptive filter determines the filter coefficient at each of the frequency components divided by the first frequency analysis unit and the frequency components divided by the second frequency analysis unit. Thus, the filter coefficient corresponding to the actual acoustic space can correctly be determined.

Preferably, the microphone collects sound including the input sound sent from the loudspeaker and ambient noise. If ambient noise exists at the microphone position, the total power of the input sound can be determined without any effects of the ambient noise.

Preferably, the input sound processor further includes a total power determining unit that determines total power of the sound collected by the microphone, and a subtracting unit that subtracts the total power of the input sound at the microphone determined by the product-sum operation unit using the product-sum operation from the total power determined by the total power determining unit to determine total power of the ambient noise. Thus, not only the total power of an input sound at the microphone position but also the total power of ambient noise, which does not include the input sound, can be determined.

The input sound is preferably a guide voice produced from an in-vehicle device. The total power of the guide voice produced from the in-vehicle device can be determined, thus allowing gain control of the guide voice in a vehicle cabin having relatively high ambient noise.

DESCRIPTION OF THE PREFERRED EMBODIMENTS

An input sound processor according to embodiments of the present invention will now be described with reference to the drawings.

First Embodiment

Figure 1:
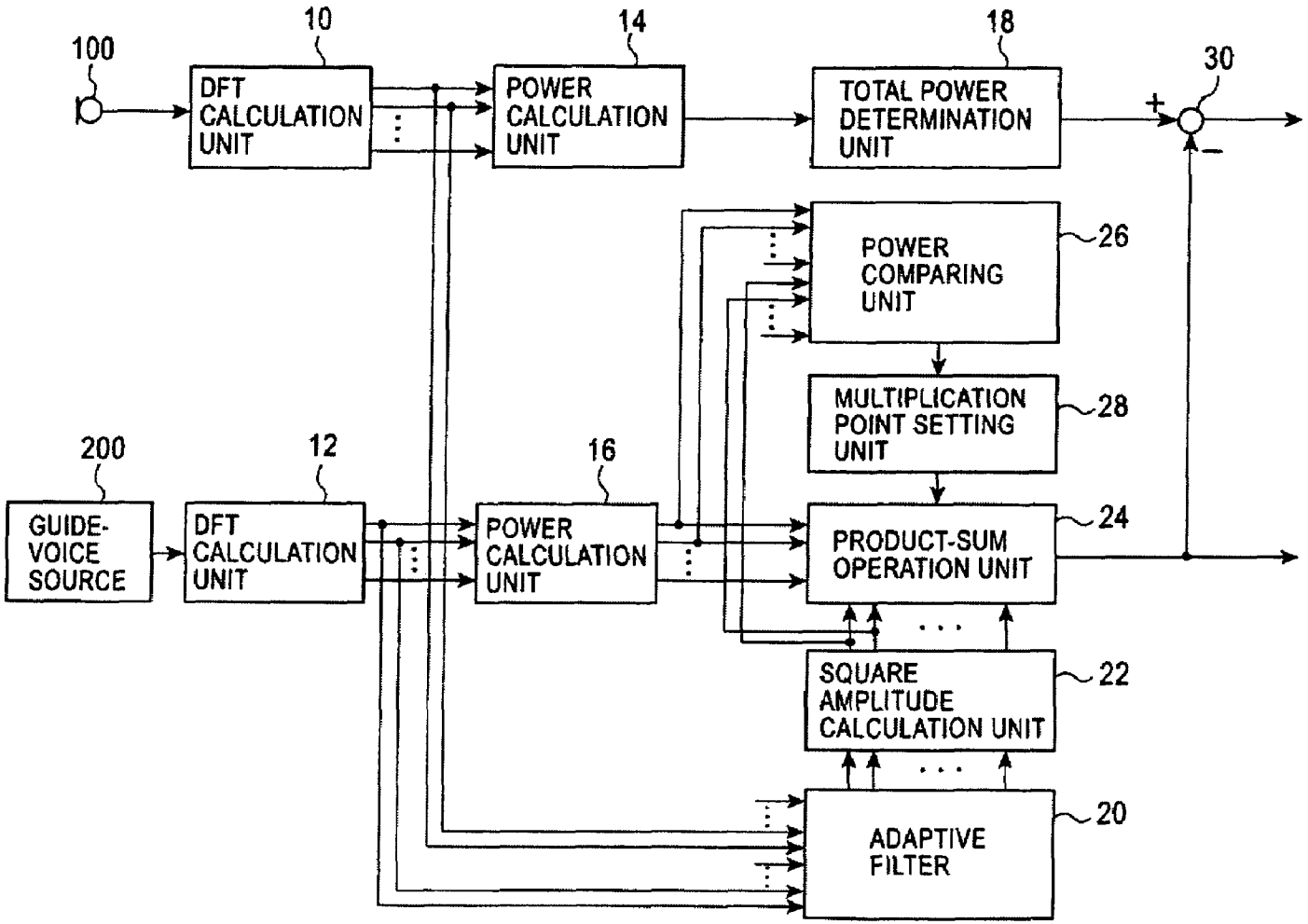
FIG. 1 is a block diagram of an input sound processor according to a first embodiment of the present invention.

FIG. 1 is a block diagram of an input sound processor according to a first embodiment of the present invention. The input sound processor shown in FIG. 1, which is installed in a vehicle, estimates the power of a guide voice at the position of a microphone 100, and extracts ambient noise other than the guide voice from sound collected by the microphone 100 to determine the power of the noise.

The input sound processor according to the first embodiment includes the microphone 100, discrete Fourier transform (DFT) calculation units 10 and 12, power calculation units 14 and 16, a total power determination unit 18, an adaptive filter 20, a square amplitude calculation unit 22, a product-sum operation unit 24, a power comparing unit 26, a multiplication point setting unit 28, and an adder 30.

The DFT calculation unit 10 performs DFT on a signal sent from the microphone 100 to extract the signal level at each frequency component. The input sound processor further includes an analog-to-digital converter before the DFT calculation unit 10 for converting the output signal from the microphone 100 into digital data, and the digital data is input to the DFT calculation unit 10. For example, the DFT calculation unit 10 determines the signal levels at 1024 points into which the audible frequency bandwidth is divided. The microphone 100 is located at a predetermined position in the vehicle cabin, which is assumed to be a user's listening point, e.g., a certain point on the steering wheel.

The power calculation unit 14 determines the power of the signal level at each frequency component determined by the DFT calculation unit 10. Specifically, the square of each of the real part and imaginary part of the signal sent from the DFT calculation unit 10 is calculated and the squares are summed to determine the sound power at each frequency component. The total power determination unit 18 determines the total power of sound collected by the microphone 100 by summing the powers at frequency components determined by the power calculation unit 14.

The DFT calculation unit 12 performs DFT on a guide voice signal sent from a guide voice source 200 to extract the signal level at each frequency component. The input sound processor further includes an analog-to-digital converter before the DFT calculation unit 12, like the DFT calculation unit 10, for converting the guide voice signal sent from the guide voice source 200 into digital data, which is then sent to the DFT calculation unit 12. The DFT calculation unit 12 determines the signal levels at the same number (e.g., 1024) of frequency components as the frequency components handled by the DFT calculation unit 10. The guide voice source 200 is, for example, a navigation apparatus that sends a signal corresponding to a guide voice, e.g., intersection guidance during route guidance. This guide voice is sent from a loudspeaker (not shown) into the vehicle cabin, and reaches the microphone 100. The microphone 100 collects sound including the guide voice and various types of ambient noise, such as audio sound and road noise.

The power calculation unit 16 determines the power of the signal level at each frequency component determined by the DFT calculation unit 12. The adaptive filter 20 identifies the transfer characteristic in the vehicle cabin from the loudspeaker from which the guide voice is sent to the microphone 100 based on the output signals of the DFT calculation units 10 and 12.

As described above, the guide voice sent from the guide voice source 200 has first and second paths. In the first path, the guide voice is sent from the loudspeaker to the microphone 100 via the acoustic space of the vehicle cabin, and the corresponding signal is sent to the DFT calculation unit 10. In the second path, the guide voice signal is sent directly to the DFT calculation unit 12. The first path includes the acoustic space of the vehicle cabin, and the second path does not include the acoustic space of the vehicle cabin. Therefore, an adaptive equalization performed based on the output signals of the DFT calculation units 10 and 12 allows for estimation of the transfer characteristic in the acoustic space of the vehicle cabin. The adaptive filter 20 outputs the transfer characteristic in terms of a filter coefficient (tap coefficient) allocated to each frequency component. The square amplitude calculation unit 22 determines a square amplitude value by calculating the square of each of the real part and imaginary part of each filter coefficient of the adaptive filter 20 and then calculating a sum of the squares.

The power comparing unit 26 receives the power (P) at each frequency component of the guide voice from the power calculation unit 16, and also receives the square amplitude value (C) of the adaptive filter 20 at each frequency component from the square amplitude calculation unit 22. The power comparing unit 26 compares the values P and C with a reference value R. When a product-sum operation is performed at a frequency component, if at least one of the values P and C is smaller than the reference value R or zero, the product of the values P and C becomes small. In this case, such a small value does not affect determination of the total power of the guide voice even if a product-sum operation is not performed on this value. The power comparing unit 26 determines whether or not the values P and C are equal to or smaller than the reference value R.

Generally, voices, including a guide voice, are composed of vowels and consonants. A vowel includes frequency components ranging from 100 Hz to 1 kHz, and a consonant includes frequency components ranging from 1 kHz to 8 kHz. The vowel frequency range and the consonants frequency range differ from each other. If a guide voice is composed of a vowel, the signal level at the consonant frequency range is substantially zero, and power determined by the squared signal level is therefore substantially zero. If a guide voice is composed of a consonant, the signal level at the vowel frequency range is substantially zero, and the power P is therefore substantially zero.

In view of the transfer characteristic in the space of the vehicle cabin, if the signal level is greatly attenuated at a specific frequency band, e.g., when a sound having a specific frequency does not sufficiently propagate because it may be absorbed depending upon the shape of the vehicle cabin or the material of the seats in the vehicle cabin, the value of the filter coefficient of the adaptive filter 20 at this frequency band and the square amplitude value C thereof are substantially zero. Thus, if at least one of the values P and C is substantially zero (equal to or lower than the reference value R), a product-sum operation is not performed at this frequency band.

Based on the result of the power comparing unit 26, the multiplication point setting unit 28 sets the frequency components other than a frequency component having at least one of the values P and C substantially zero (equal to or lower than the reference value R) as multiplication points at which a product-sum operation is to be performed.

The product-sum operation unit 24 performs a product-sum operation. That is, the power P at each frequency component of the guide voice determined by the power calculation unit 16 is multiplied by the square amplitude value C of each filter coefficient of the adaptive filter 20 determined by the square amplitude calculation unit 22 at the same frequency component, and a sum of the products at the multiplication points set by the multiplication point setting unit 28 is calculated. Thus, the guide voice at the position of the microphone 100 is estimated using the adaptive filter 20, and the total power of the estimated guide voice is determined by the product-sum operation unit 24.

The adder 30 subtracts the total power of the estimated guide voice at the microphone 100, which is sent from the product-sum operation unit 24, from the total power of the sound collected by the microphone 100 including the guide voice and the ambient noise, which is determined by the total power determination unit 18. Thus, the total power of only the ambient noise collected by the microphone 100 is sent from the adder 30.

The reference value R is determined so that the total power of the estimated guide voice sent from the product-sum operation unit 24 has an error lower than a predetermined value. For example, the reference value R is determined so that the error is equal to or lower than 5 dB if the maximum power at each frequency component of the guide voice sent from the power calculation unit 16 or the maximum square amplitude of each filter coefficient of the adaptive filter 20 sent from the square amplitude calculation unit 22 is $2^M$. For example, if M=16, R=398 is obtained.

The DFT calculation unit 12 serves as a first frequency analysis unit, the power calculation unit 16 serves as a first power calculating unit, the square amplitude calculation unit 22 serves as a square amplitude calculating unit, the power comparing unit 26 serves as a power comparing unit, the multiplication point setting unit 28 serves as a multiplication point setting unit, the product-sum operation unit 24 serves as a product-sum operation unit, and the DFT calculation unit 10 serves as a second frequency analysis unit. The DFT calculation unit 10, the power calculation unit 14, and the total power determination unit 18 serve as a total power determining unit, and the adder 30 serves as a subtracting unit.

Accordingly, a product-sum operation is not performed at all frequency components, but is performed only at the frequency component having an effective value. That is, a product-sum operation is not to be performed at the frequency component having substantially no power. Therefore, the amount of processing is reduced, and an inexpensive processor may be used, leading to cost savings.

In view of the transfer characteristic in the acoustic space from the loudspeaker to the microphone 100, in particular, the transfer characteristic in the space of the vehicle cabin, a sound having a specific frequency band may be absorbed, and the square amplitude of the filter characteristic at this frequency band is very low. Thus, the product of the square amplitude and the power has a small value. A product-sum operation is not performed at this frequency band, thereby reducing the amount of processing of the overall product-sum operation.

The filter coefficient is determined using the adaptive filter 20. Thus, the filter coefficient corresponding to the actual acoustic space can correctly be determined.

The adder 30 subtracts the total power of the guide voice at the microphone 100 from the total power of the signal sent from the microphone 100 to determine the total power of the ambient noise that does not include the guide voice. Thus, the gain of the guide voice can be determined using loudness compensation, thus providing an intelligible guide voice in a vehicle cabin having relatively high ambient noise.

Second Embodiment

Figure 2:
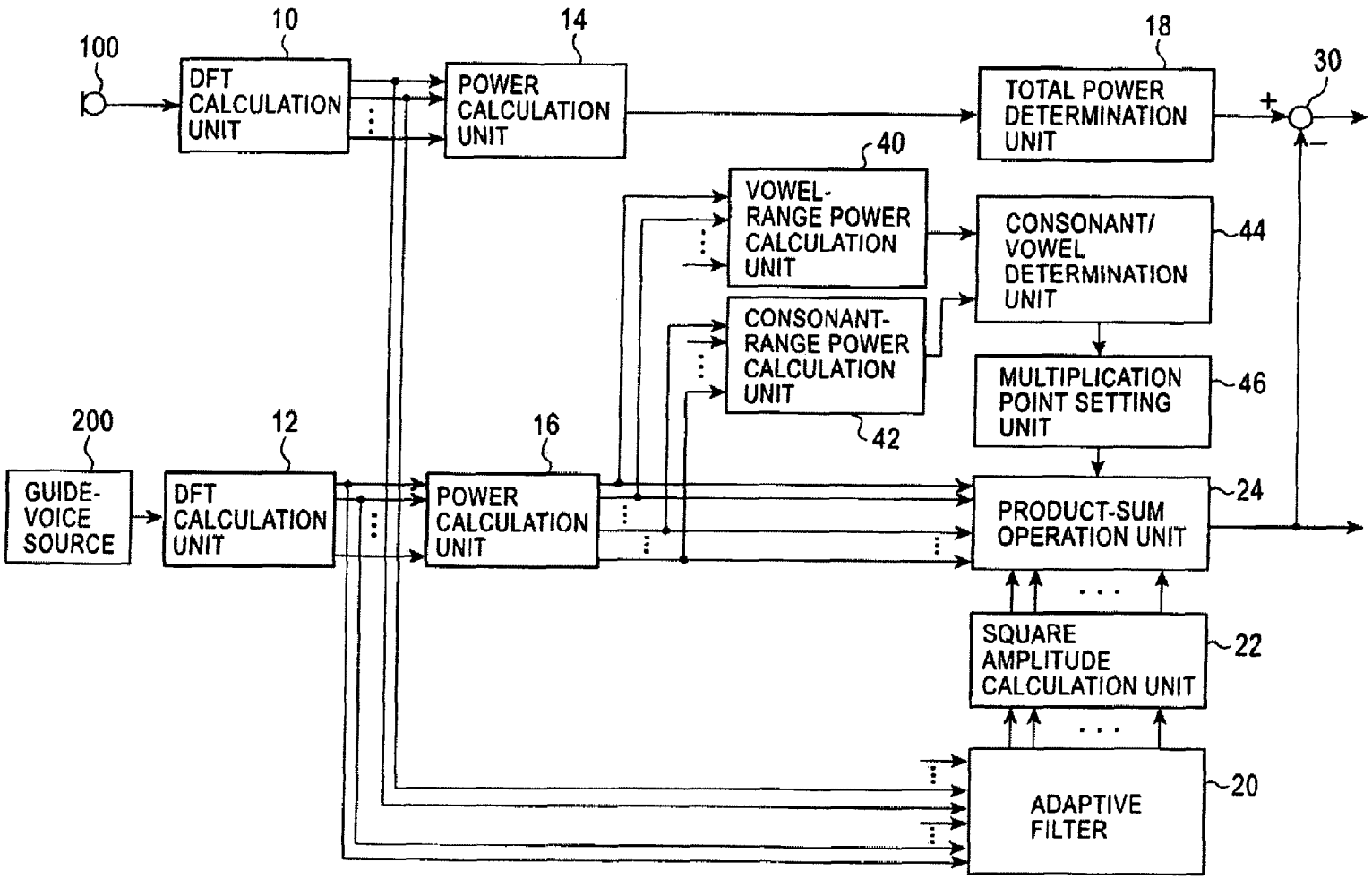
FIG. 2 is a block diagram of an input sound processor according to a second embodiment of the present invention.

FIG. 2 is a block diagram of an input sound processor according to a second embodiment of the present invention. The input sound processor shown in FIG. 2 includes a microphone 100, DFT operation units 10 and 12, power calculation units 14 and 16, a total power determination unit 18, an adaptive filter 20, a square amplitude calculation unit 22, a product-sum operation unit 24, a vowel-range power calculation unit 40, a consonant-range power calculation unit 42, a consonant/vowel determination unit 44, a multiplication point setting unit 46, and an adder 30. In place of the power comparing unit 26 and the multiplication point setting unit 28 of the input sound processor shown in FIG. 1, the input sound processor shown in FIG. 2 is provided with the vowel-range power calculation unit 40, the consonant-range power calculation unit 42, the consonant/vowel determination unit 44, and the multiplication point setting unit 46.

The vowel-range power calculation unit 40 determines the power at the vowel frequency range (hereinafter referred to as vowel-range power) by summing powers at frequency components included in the vowel frequency range. The consonant-range power calculation unit 42 determines the power at the consonant frequency range (hereinafter referred to as a consonant-range power) by summing powers at frequency components included in the consonant frequency range. The vowel-range power and the consonant-range power may not be determined at all of the corresponding frequency ranges. The vowel-range power may be determined by summing powers at some of the vowel frequency range, and the consonant-range power may be determined by summing powers at some of the consonant frequency range.

The consonant/vowel determination unit 44 compares the vowel-range power determined by the vowel-range power calculation unit 40 with the consonant-range power determined by the consonant-range power calculation unit 42 to determine whether the guide voice input from the guide voice source 200 is composed of a vowel or a consonant. As described above, the guide voice is composed of exclusively a vowel or a consonant, and it can be easily determined whether the guide voice at the present time is composed of a vowel or a consonant by comparing the vowel-range power with the consonant-range power.

If the consonant/vowel determination unit 44 determines that the guide voice is composed of a vowel, the multiplication point setting unit 46 sets the frequency components included in the vowel frequency range as multiplication points at which a product-sum operation is to be performed. If the consonant/vowel determination unit 44 determines that the guide voice is composed of a consonant, the multiplication point setting unit 46 sets the frequency components included in the consonant frequency range as multiplication points at which a product-sum operation is to be performed.

The product-sum operation unit 24 performs a product-sum operation. That is, the power at each frequency component of the guide voice determined by the power calculation unit 16 is multiplied by the square amplitude of each filter coefficient of the adaptive filter 20 determined by the square amplitude calculation unit 22 at the same frequency component, and a sum of the products at the multiplication points set by the multiplication point setting unit 46 is calculated. Thus, the guide voice at the position of the microphone 100 is estimated using the adaptive filter 20, and the total power of the estimated guide voice is determined by the product-sum operation unit 24.

The multiplication point setting unit 46 serves as a multiplication point setting unit, the consonant/vowel determination unit 44 serves as a consonant or vowel determining unit, the vowel-range power calculation unit 40 serves as a vowel-range power determining unit, and the consonant-range power calculation unit 42 serves as a consonant-range power determining unit.

The guide voice has large variations in the values of frequency components depending upon a consonant or a vowel. Specifically, if the guide voice is composed of a consonant, the frequency components specific to the consonant have values, while the other frequency components have a value of substantially zero. If the guide voice is composed of a vowel, the frequency components specific to the vowel have values, while the other frequency components have a value of substantially zero. By determining whether the guide voice is composed of a vowel or a consonant, a frequency component having substantially no power can be identified, and a product-sum operation at this frequency component can be omitted. Therefore, the amount of processing can be reduced, and an inexpensive processor can be used, leading to cost savings.

The present invention is not limited to the illustrated embodiments, and a variety of modifications may be made without departing from the scope of the present invention. While the power of a guide voice sent from the guide voice source 200 is estimated in the illustrated embodiments, the total power of any other sound at the microphone position may be estimated. The present invention may be applied to estimation of sound power for a broadcast produced from a radio receiver or the like.

In the first embodiment, an audio device may be used in place of the guide voice source 200, and the total power of audio sound or the like at the microphone 100 may be estimated.

In the illustrated embodiments, the DFT calculation units 10 and 12 are used to divide an input signal into frequency components. Alternatively, any other method, such as a filter bank method, may be used to divide an input signal into frequency components.

What is claimed is:

1. An input sound processor for estimation of the total power of an input sound received by a microphone, comprising:

first frequency analysis means for dividing an input sound signal sent to a loudspeaker into a plurality of frequency components;

first power calculating means for determining the sound power at each of the frequency components;

square amplitude calculating means for determining a square amplitude of a filter coefficient at each of the frequency components, the filter coefficient comprising a filter characteristic corresponding to a transfer characteristic of an acoustic space located between the loudspeaker and the microphone;

power comparing means for comparing the sound power at each of the frequency components with a reference value;

multiplication point setting means for setting multiplication points indicating frequency components at which the total power of the input sound is to be determined based upon a comparison result produced by the power comparing means; and product-sum operation means for performing a product-sum operation at the multiplication points using the sound power at each of the frequency components and the square amplitude of the filter coefficient at each of the frequency components.

2. The input sound processor according to claim 1, wherein the multiplication point setting means sets multiplication points indicating frequency components other than frequency components having power equal to or lower than the reference value.

3. The input sound processor according to claim 1, wherein the power comparing means compares the sound power at each of the frequency components with the reference value, and compares the square amplitude of the filter coefficient at each of the frequency components with the reference value, and the multiplication point setting means sets multiplication points indicating frequency components other than frequency components having at least one of the sound power and the square amplitude equal to or lower than the reference value.

4. An input sound processor for estimation of the total power of an input sound received by a microphone, comprising:

first frequency analysis means for dividing an input sound signal sent to a loudspeaker into a first plurality of frequency components;

first power calculating means for determining the sound power at each of the frequency components;

square amplitude calculating means for determining a square amplitude of a filter coefficient at each of the frequency components, the filter coefficient comprising a filter characteristic corresponding to a transfer characteristic of an acoustic space located between the loudspeaker and the microphone;

consonant or vowel determining means for determining whether the input sound comprises a consonant or a vowel;

multiplication point setting means for setting multiplication points indicating frequency components at which the total power of the input sound is to be determined based upon a determination result produced by the consonant or vowel determining means; and product-sum operation means for performing a product-sum operation at the multiplication points using the sound power at each of the frequency components and the square amplitude of the filter coefficient at each of the frequency components.

5. The input sound processor according to claim 4, wherein the consonant or vowel determining means compares the sound power at a vowel frequency range with the sound power at a consonant frequency range to determine whether the input sound comprises a consonant or a vowel.

6. The input sound processor according to claim 5, wherein the vowel frequency range is 100 Hz to 1 kHz, and the consonant frequency range is 1 kHz to 8 kHz.

7. The input sound processor according to claim 5, further comprising:

consonant-range power determining means for determining the total power of the consonant frequency range by summing the sound powers at frequency components in the consonant frequency range; and vowel-range power determining means for determining the total power of the vowel frequency range by summing the sound powers at frequency components in the vowel frequency range.

8. The input sound processor according to claim 4, further comprising an adaptive filter that determines the filter coefficient.

9. The input sound processor according to claim 8, further comprising second frequency analysis means for dividing a signal received by the microphone into a second plurality of frequency components, wherein the adaptive filter determines the filter coefficient at each of the frequency components divided by the first and the second frequency analysis means.

10. The input sound processor according to claim 9, wherein the sound received by the microphone includes the input sound produced by the loudspeaker and ambient noise.

11. The input sound processor according to claim 10, further comprising:

total power determining means for determining the total power of the sound received by the microphone; and subtracting means for subtracting the result determined by the product-sum operation means from the result determined by the total power determining means to determine the total power of the ambient noise.

12. The input sound processor according to claim 4, wherein the input sound comprises a guide voice produced from an in-vehicle device.

13. A method for estimating via a processor the total power of an input sound received by a microphone, comprising performing in said processor:

dividing an input sound signal sent to a loudspeaker into a first plurality of frequency components;

determining the sound power at each of the first plurality of frequency components;

determining a square amplitude of a filter coefficient at each of the first plurality of frequency components, the filter coefficient comprising a filter characteristic corresponding to a transfer characteristic of an acoustic space located between the loudspeaker and the microphone;

comparing the sound power at each of the first plurality of frequency components with a reference value; and performing a product-sum operation of the sound power of each of the first plurality of frequency components approximately equal to or above the reference level and the square amplitude of the filter coefficient of each of the first plurality of frequency components approximately equal to or above the reference level whereby the total power of the input sound at the position of the microphone is estimated by said processor.

14. The method of claim 13, comprising setting multiplication points indicating frequency components from which the total power of the input sound is to be determined based upon the comparison of the sound power at each of the first plurality of frequency components with the reference value.

15. The method of claim 13, comprising:

determining whether the input sound comprises a consonant or a vowel; and setting multiplication points indicating frequency components from which the total power of the input sound is to be determined based upon whether the input sound comprises a consonant or vowel.

16. The method of claim 13, comprising:

determining whether the input sound comprises a consonant or a vowel;

determining the total power of a consonant frequency range by summing the sound powers at frequency components in the consonant frequency range; and determining the total power of a vowel frequency range by summing the sound powers at frequency components in the vowel frequency range.

17. The method of claim 16, comprising providing an adaptive filter that determines the filter coefficient.

18. The method of claim 17, comprising dividing a signal received by the microphone into a second plurality of frequency components, wherein the adaptive filter determines the filter coefficient at each of the first and second plurality of frequency components.

19. The method of claim 13, comprising receiving sound via the microphone, the sound received including the input sound produced by the loudspeaker and ambient noise.

20. The method of claim 19, comprising:

dividing the sound received by the microphone into a second plurality of frequency components;

determining the total power of the sound received by the microphone; and subtracting the result determined by the product-sum operation from the total power of the sound received by the microphone to determine the approximate level of ambient noise received by the microphone.

* * * * *